US009310145B2

(12) United States Patent
Colongo et al.

(10) Patent No.: US 9,310,145 B2
(45) Date of Patent: Apr. 12, 2016

(54) HEAT FLOW DEVICE

(71) Applicant: AIRBUS OPERATIONS (S.A.S.), Toulouse (FR)

(72) Inventors: Emile Colongo, Montesquieu Volvestre (FR); Stephane Ortet, Mondonville (FR)

(73) Assignee: AIRBUS OPERATIONS S.A.S., Toulouse (FR)

( * ) Notice: Subject to any disclaimer, the term of this patent is extended or adjusted under 35 U.S.C. 154(b) by 645 days.

(21) Appl. No.: 13/716,951

(22) Filed: Dec. 17, 2012

(65) Prior Publication Data

US 2013/0098594 A1 Apr. 25, 2013

Related U.S. Application Data

(62) Division of application No. 12/373,988, filed as application No. PCT/FR2007/001223 on Jul. 17, 2007, now abandoned.

(30) Foreign Application Priority Data

Jul. 18, 2006 (FR) ..... 06 53016

(51) Int. Cl.
*F28F 13/00* (2006.01)
*F28F 27/00* (2006.01)

(52) U.S. Cl.
CPC ..... *F28F 27/00* (2013.01); *F28F 13/00* (2013.01); *F28F 2013/008* (2013.01); *F28F 2265/10* (2013.01); *F28F 2270/00* (2013.01)

(58) Field of Classification Search
CPC ..... F28F 2013/005; F28F 2013/008
USPC ..... 165/272, 276, 287, 277
See application file for complete search history.

(56) References Cited

U.S. PATENT DOCUMENTS

| | | | | |
|---|---|---|---|---|
| 3,391,728 | A * | 7/1968 | Kelly | 165/277 |
| 3,399,717 | A * | 9/1968 | Cline | 165/276 |
| 3,463,224 | A * | 8/1969 | Myers | 165/276 |
| 3,519,067 | A | 7/1970 | Schmidt | |
| 4,212,346 | A * | 7/1980 | Boyd | 165/277 |
| 4,281,708 | A * | 8/1981 | Wing et al. | 165/277 |

(Continued)

FOREIGN PATENT DOCUMENTS

| | | |
|---|---|---|
| DE | 101 23 473 A1 | 11/2002 |
| DE | 103 42 425 A1 | 1/2005 |

(Continued)

OTHER PUBLICATIONS

Japanese Office Action Issued Jan. 8, 2013 in Patent Application No. 2009-520011 (with English translation).

(Continued)

*Primary Examiner* — Marc Norman
*Assistant Examiner* — Devon Russell
(74) *Attorney, Agent, or Firm* — Oblon, McClelland, Maier & Neustadt, L.L.P.

(57) ABSTRACT

A device comprises equipment (101) with a heat source, a cold part (102) relative to the equipment, and a thermal conductor element (103) capable of conducting the heat from the equipment to the cold part. The element (103) is such that, under certain thermal conditions above a given thermal condition, the equipment and the cold part are essentially thermally isolated.

16 Claims, 2 Drawing Sheets

(56) References Cited

U.S. PATENT DOCUMENTS

| | | | | |
|---|---|---|---|---|
| 4,384,610 | A | 5/1983 | Cook et al. | |
| 4,402,358 | A | 9/1983 | Wolf | |
| 4,742,867 | A | 5/1988 | Walsh | |
| 5,188,909 | A | 2/1993 | Pedicini | |
| 5,216,580 | A | 6/1993 | Davidson et al. | |
| 5,322,114 | A | 6/1994 | Grabner | |
| 5,379,601 | A * | 1/1995 | Gillett | 62/51.1 |
| 6,047,766 | A | 4/2000 | Van Brocklin et al. | |
| 6,435,454 | B1 * | 8/2002 | Engelhardt | 244/117 A |
| 6,768,781 | B1 | 7/2004 | Moriarty | |
| 7,755,899 | B2 * | 7/2010 | Stenmark | 361/710 |
| 7,827,969 | B2 * | 11/2010 | Yamamoto et al. | 123/509 |
| 2003/0196787 | A1 * | 10/2003 | Mahoney | 165/274 |
| 2006/0037589 | A1 * | 2/2006 | Gupta et al. | 123/557 |
| 2006/0060367 | A1 | 3/2006 | Schultz | |
| 2006/0061966 | A1 | 3/2006 | Korinsky et al. | |
| 2006/0141308 | A1 | 6/2006 | Becerra et al. | |
| 2009/0283251 | A1 | 11/2009 | Colongo et al. | |

FOREIGN PATENT DOCUMENTS

| | | | |
|---|---|---|---|
| EP | 1 642 333 | | 4/2006 |
| GB | 1 356 115 | | 6/1974 |
| GB | 1356115 | A | 6/1974 |
| JP | 63-161388 | A | 7/1988 |
| JP | 1-110245 | A | 4/1989 |
| JP | 2-14568 | U | 1/1990 |
| JP | 3-43701 | U | 4/1991 |
| JP | 9-269122 | A | 10/1997 |
| JP | 2000-105088 | A | 4/2000 |
| JP | 2002-372225 | A | 12/2002 |
| JP | 2004-347205 | A | 12/2004 |
| JP | 2005-236266 | | 9/2005 |
| JP | 2006233955 | A * | 9/2006 |
| RU | 2 161 384 | C1 | 12/2000 |
| RU | 2 183 310 | C1 | 6/2002 |
| RU | 2212358 | C1 | 9/2003 |
| TW | I229789 | B | 3/2005 |
| WO | WO 2005/031860 | A2 | 4/2005 |
| WO | WO 2005/063566 | A2 | 7/2005 |

OTHER PUBLICATIONS

Office Action issued Feb. 5, 2013 in Japanese Patent Application No. 2009-520012 with English language translation.

Russian Office Action issued Jul. 28, 2011, in Patent Application No. 2009105501/06.

Chinese Office Action issued Jun. 23, 2011, in Patent Application No. 200780027085.0 (with English-language translation).

B. A. Ariekceeb, "Cooling of radio electronic apparatuses by use of melting substances", 1975, pp. 67-76 (with partial English translation).

Office Action issued Feb. 28, 2012, in Japanese Patent Application No. 2009-520012 (with English language translation).

Japanese Office Action issued Feb. 14, 2012 in Patent Application No. 2009-520011 with English Translation.

* cited by examiner

HEAT FLOW DEVICE

CROSS-REFERENCE TO RELATED APPLICATIONS

This application is a divisional of U.S. Application Ser. No. 12/373,988, filed Jan. 15, 2009, which is incorporated herein by reference in its entirety. U.S. application Ser. No. 12/373,988 is a U.S. national stage application under 35 U.S.C. §371 of International Application No. PCT/FR2007/001223 filed Jul. 17, 2007, which claims priority to French Application No. 0653016 filed Jul. 18, 2006.

The invention relates to a heat-flow device.

In such a device it is sought to evacuate the thermal energy (or heat) dissipated in an equipment item by a heat source of any kind (such as an electrical circuit or an electronic component).

This is traditionally achieved by connecting the equipment item, by means of a heat-conducting member, to a relatively colder part, which acts as a cold source.

Thus an amount of heat flows across the conductive member, with a power inversely proportional to the thermal resistance thereof, thus making it possible to evacuate at least part of the heat generated within the equipment item and thus to avoid overheating it.

US Patent Application 2003/0196787, for example, uses this technique and also proposes, for reasons related to the operation of the equipment item, to reduce such evacuation of heat at low temperature.

The inventors have noted that these solutions could present risks in practice, especially when the part constituting the cold source is not adapted to all conditions of temperature and/or of dissipated thermal power, as is the case, for example, when this cold part is formed from a material that is combustible or sensitive to temperature elevations.

In order to avoid such problems, the invention proposes a device comprising an equipment item with a heat source, a part relatively colder than the equipment item and a member capable of transmitting the heat (especially by conduction) from the equipment item to the cold part, characterized in that the member is such that, under certain thermal conditions situated above a given thermal condition, the equipment item and the cold part are substantially insulated thermally.

In this way the heat generated within the equipment item is no longer transmitted to the cold part when these thermal conditions (for example, of temperature or of thermal power across the member) are encountered, or in other words when the given thermal condition is exceeded, and overheating of the said cold part is avoided.

The equipment item and the cold part may additionally be separated substantially by a gas screen, at least under the said thermal conditions, in order that the transmission of electrical phenomena (such as electrical arcs), especially the propagation of electrical arcs from the equipment item to the cold source, can also be avoided under these conditions: in this case, the equipment item and the cold part are effectively insulated electrically.

In practice, the element comprises, for example, a good heat conductor outside the said thermal conditions (or in other words, beyond the given thermal condition).

According to one conceivable embodiment, the member is such that its thermal resistance is capable of increasing under the said thermal conditions, in such a way that the member becomes substantially insulating. In this way the thermal insulation of the equipment item and of the cold source is made possible by the modification of the thermal-conduction properties of the member.

According to one possible solution, the member comprises at least one component whose change of state (for example from the liquid state to the gas state) under the said thermal conditions causes an increase of the said thermal resistance. In this case, advantage is taken of the increase in thermal resistance generally associated with such a change of state. The component may then form the said screen after the said change of state, which is a practical way of obtaining this screen.

According to another conceivable embodiment, the member is configured to lose contact with the equipment item or the cold part under the said thermal conditions. In this case it is the breaking of contact between the different components that causes the interruption of the heat path between the equipment item and the cold part.

The member in this case comprises, for example, at least one component whose change of state under the said thermal conditions causes the said loss of contact.

In this context it is possible to provide that the said component participates in conduction from the equipment item to the cold part outside the said thermal conditions, and disappears due to its change of state under the said thermal conditions, thus substantially insulating the equipment item and the cold part.

According to another approach, which may be combined if applicable with the foregoing, the change of a mechanical property of the component during its change of state may lead to a movement of part of the member, thus causing the said loss of contact.

In this case also, the member may be configured in such a way that the change of state of the component makes it possible to form the said gas screen. The change of state then makes it possible not only to interrupt the thermal path but also to prevent the propagation of electrical phenomena.

In this context the change of state may be a transition from the solid state to the liquid state or a transition from the liquid state to the gas state.

The equipment may be a fuel pump and the cold part a liquid fuel, for example in an aircraft; the invention is particularly interesting in this context, although it naturally has numerous other applications, such as protection against overheating of members of heat sinks that are sensitive to temperature elevations, such as carbon structures.

The arrangements proposed hereinabove, some of which are optional, thus make it possible in particular to evacuate the heat produced by the equipment items, such as electronic components as in the case of fuel pumps, while avoiding overheating of the heat sink (such as the fuel) as well as propagation of electrical arcs from the equipment items to this sink.

The invention also proposes an aircraft equipped with such a device.

Other characteristics and advantages of the invention will become evident in light of the description hereinafter with reference to the attached drawings, wherein:

FIG. 1A represents a first exemplary embodiment of the invention under normal operating conditions.

In this example, a hot plate 101 comprising a heat source (not illustrated) is connected to a cold plate 102 (such as a structural part of the device) by means of a material 103 that is solid at the nominal temperature $T_{nominal}$ corresponding to normal operation.

Material 103 is a heat conductor, and its thermal resistance $R_{material}$ is therefore relatively low. Thus the heat generated by the heat source within hot plate 101 is evacuated under normal operating conditions across material 103 to cold plate 102, which acts as a heat sink or cold source.

Material 103 is also chosen such that its melting temperature $T_{melting}$ is lower than or equal to the desired maximum operating temperature $T_{max}$. Such a maximum temperature may be desired, for example, to avoid degradation of cold plate 102 or other negative consequences, such as, for example, a risk of fire when the cold plate is made in the form of a combustible material, such as the fuel of an aircraft.

Figure 1A:
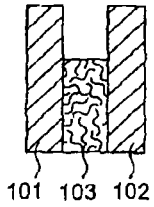
FIGS. 1A to 1C represent a first exemplary embodiment of the invention.
Figure 1B:
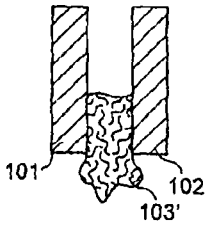

Thus, as represented in FIG. 1B, when the temperature T of material 103 attains the melting temperature $T_{melting}$ of material 103, for example due to a departure from normal operating conditions, the said material changes state: material 103 passes from the solid state to the liquid state (represented by reference 103' in FIG. 1B), which leads to its disappearance (in this case its flow via appropriate means) from its initial position in contact with hot plate 101 and cold plate 102.

Figure 1C:
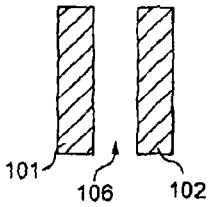

Because of this fact, when the temperature between plates 101, 102 is higher than the desired maximum temperature $T_{max}$, hot plate 101 and cold plate 102 are no longer connected by the material but are separated by an air screen 106, whose thermal resistance $R_{air}$ is very much greater than that of the material $R_{material}$, as represented in FIG. 1C.

Cold plate 102 is then thermally insulated from hot plate 101 by virtue of air screen 106 separating them; this screen also acts as an electrical insulator, which also makes it possible to prevent transmission of electrical energy (for example, in the form of electrical arcs) from the hot plate to cold plate 102. This latter advantage is particularly interesting in the case in which hot plate 101 is provided with an electrical or electronic equipment item whose potential malfunctions could prove dangerous to cold plate 102, especially when this has attained a temperature above the desired maximum temperature $T_{max}$.

Wax is used, for example, as material 103, since its thermal properties permit heat conduction clearly greater than that permitted by the thermal resistance of air 106.

Figure 2A:
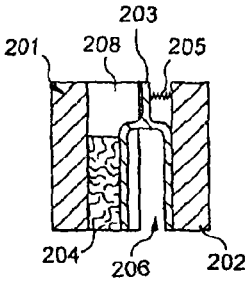
FIGS. 2A to 2C represent a second exemplary embodiment of the invention.

FIG. 2A represents a second exemplary embodiment of the invention under normal operating conditions, that is, for example, at an operating temperature $T_{nominal}$ clearly lower than a desired maximum temperature.

In this example, an equipment item 201 comprising a heat source is situated at a distance from a cold plate 202 and is consequently separated from it by an air screen 206. Furthermore, equipment item 201 is connected to cold plate 202 by means of a heat drain 203 formed in a material that is a good heat conductor (that is having low thermal resistance) and that therefore extends partly into the space formed by air screen 206.

Heat drain 203 is maintained in contact with cold plate 202 by interposition of a bonding material 204 in solid state between a part of equipment item 201 and conducting drain 203. Furthermore, a compression spring 205 is interposed between drain 203 and cold plate 202, spring 205 being compressed when drain 203 is in contact with cold plate 202.

Drain 203 is connected to equipment 201, on the one hand across bonding material 204 and on the other hand directly at parts of equipment item 201 other than those receiving bonding material 204, for example at a side wall 208 of equipment item 201.

Figure 2B:
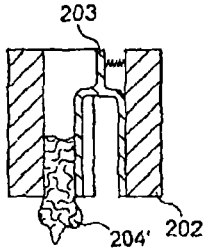

When the temperature in bonding material 204 rises beyond the normal operating conditions and attains the melting temperature $T_{melting}$ of bonding material 204, the latter passes from the solid state to the liquid state (as represented in FIG. 2B, in which the bonding material in liquid state is represented by reference 204'), and flows away from the device via appropriate means.

Figure 2C:
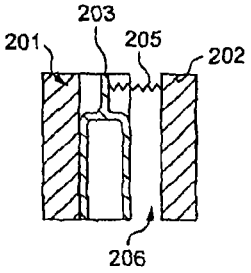

Because of this fact, drain 203 is no longer maintained in contact with cold plate 202 but instead is moved away under the action of spring 205. Because of the displacement of drain 203 and its loss of contact with cold plate 202, equipment item 201 and cold plate 202 are separated by the thickness (or screen) of air 206, except for spring 205, whose thermal conductivity is negligible, and these two members are therefore substantially insulated by means of air screen 206, as represented in FIG. 2C.

Figure 2D:
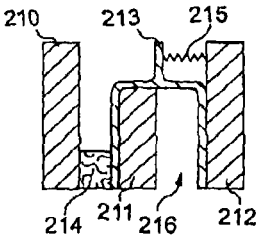
FIGS. 2D to 2F represent a variant of the second example presented in FIGS. 2A to 2C.

FIG. 2D represents a variant, under normal operating conditions, of the second example just described.

As for the second example described in the foregoing, an equipment item 211 comprising a heat source is situated at a distance from a cold plate 212 and consequently separated therefrom by an air screen 216. Furthermore, equipment item 211 is connected to cold plate 212 by means of a heat drain 213 formed in a material that has low thermal resistance and that therefore extends partly into the space formed by air screen 216.

According to this variant, however, heat drain 213 is maintained braced against cold plate 212 by means of a solid block 214 interposed between conducting drain 213 and a structural part 210. Furthermore, as in the second example, a compression spring 215 is interposed between drain 213 and cold plate 212, spring 215 being compressed when drain 213 is in contact with cold plate 212 because of the presence of solid block 214.

Thus, according to the present variant, solid block 214 does not necessarily participate in the flow of heat.

Figure 2E:
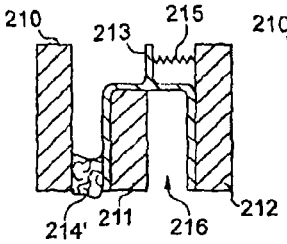

When the temperature in solid block 214 rises beyond the normal operating conditions and attains the melting temperature $T_{melting}$ of the material constituting block 214, this passes from the solid state to the liquid state (as represented in FIG. 2E, in which the molten block is represented by reference 214'), and flows away from the device via appropriate means.

Because of this fact, drain 213 is no longer maintained in contact with cold plate 212 but instead is moved away under the action of spring 215. Because of the displacement of drain 213 and its loss of contact with cold plate 212, equipment item 211 and cold plate 212 are separated by the thickness (or screen) of air 216, except for spring 215, whose thermal conductivity is negligible, and these two members are therefore substantially insulated by means of air screen 216.

Figure 2F:
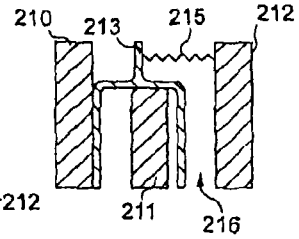

According to the embodiment represented in FIG. 2F, the displacement of drain 213 then continues until it comes into contact with structural part 210, which then in this case could in turn act as a heat sink.

Figure 3A:
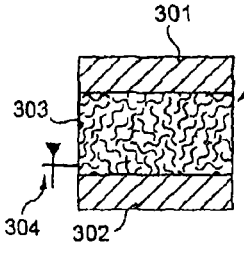
FIGS. 3A to 3C represent a third exemplary embodiment of the invention.

FIG. 3A represents a third exemplary embodiment of the invention under normal operating conditions.

According to this example, heat-generating equipment item 301 and cold part 302 acting as cold source are situated respectively in the upper part and the lower part of a chamber 305.

A space formed in the chamber between equipment item 301 and cold part 302 is filled with a bonding material 303 in liquid form having low thermal resistance, and which forms a heat-conduction path between equipment 301 and cold part 302.

Chamber 305 hermetically houses equipment item 301, bonding material 303 and cold part 302. Only a safety valve 304 penetrating into the chamber in the space filled with bonding material 303 makes it possible, if necessary, to evacuate liquid when the pressure exceeds a threshold, as explained hereinafter.

Bonding material 303 is such that its vaporization temperature corresponds approximately (and preferably is slightly lower) to a desired maximum temperature in cold part 302.

Figure 3B:
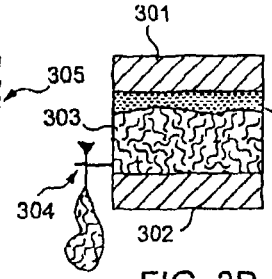
Figure 3C:
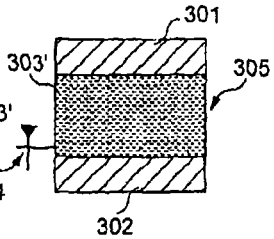

Because of this fact, when the temperature of the bonding material exceeds the vaporization temperature (and therefore attains the desired maximum temperature), for example by reason of a malfunction of equipment item 301, bonding material 303 passes from the liquid state to the gas state during a phase represented in FIG. 3B (the material in gaseous form 303' naturally appearing in the upper part of the space of chamber 305 previously occupied by the liquid, in contact with equipment item 301).

The change of state in hermetic chamber 305 causes a pressure rise therein until the pressure attains the trip threshold of safety valve 304, and the liquid part of bonding material 303 consequently begins to escape, as represented in FIG. 3B.

If the temperature continues to rise beyond the vaporization temperature of bonding material 303, the phenomenon just described and illustrated in FIG. 3B continues until the space of chamber 305 situated between equipment item 301 and cold part 302 is completely filled with gas phase 303' of the bonding material.

The heat path initially formed by bonding material 303 in liquid form is therefore interrupted, and by virtue of this fact cold part 302 is thermally insulated from equipment item 301, since the thermal resistance of the bonding material in gaseous form is much greater than that of the bonding material in liquid form.

It is noted that the change of phase (or in other words the transition from the liquid state to the gas state) of the bonding material has also made it possible to replace the heat path by a gas screen, which makes it possible in particular to prevent the formation of electrical arcs between equipment item 301 and cold part 302.

Figure 4A:
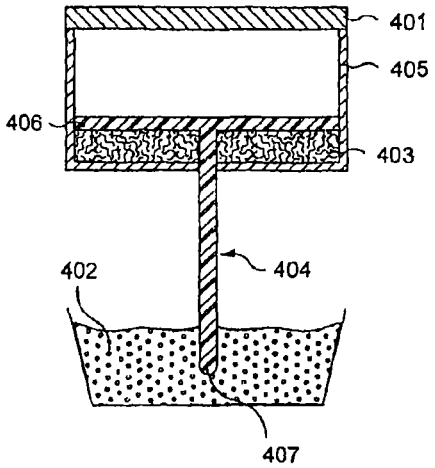
FIGS. 4A to 4C represent a fourth exemplary embodiment of the invention.

FIG. 4A represents a fourth exemplary embodiment of the invention under normal operating conditions, or in other words for temperatures (including the normal operating temperature) clearly lower than a permitted maximum temperature.

In this exemplary embodiment, a chamber 405 is formed in the lower prolongation of a hot plate 401 (which constitutes, for example, part of an equipment item containing a heat source, such as a fuel pump with which the aircraft are equipped).

Chamber 405 is hermetic and its lower part contains, under normal operating conditions, a liquid component 403.

Part of a heat drain 404 is also accommodated inside chamber 405: an upper part 406 (substantially horizontal in this case) extends over the entire surface (horizontal in this case) of chamber 405, in such a way as to form a piston separating an upper part of chamber 405, filled with air, for example, from a lower part of chamber 405, filled with liquid component 403 under normal operating conditions.

It can therefore be considered that the drain floats on liquid component 403 during normal operation.

Heat drain 404 also comprises a rod (substantially vertical in this case), a lower part 407 of which is in contact, during normal operation as illustrated in FIG. 4A, with a cold part forming a heat sink, in this case composed of liquid fuel 402 of the aircraft. Lower part 407 in this case is precisely immersed in fuel 402 as represented in FIG. 4A.

In the normal operating configuration shown in FIG. 4A (in other words, especially at nominal operating temperature), a heat path is therefore formed between equipment item 401 and cold part 402 by means of materials having relatively low thermal resistance, namely in this case the walls of chamber 405, liquid component 403 and heat drain 404.

Figure 4B:
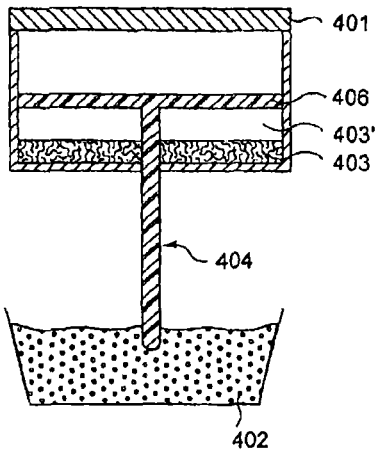
Figure 4C:
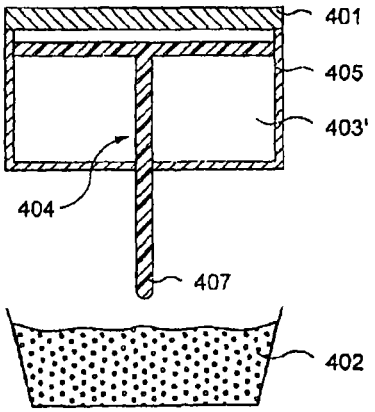

When the temperature in chamber 405 rises above the nominal operating temperature (for example, because of a malfunction of equipment item 401) and attains the vaporization temperature of liquid component 403 (preferably chosen to be lower than a permitted maximum temperature inside chamber 405, which corresponds, for example, to a temperature beyond which risks exist due to the presence of fuel 402), a gas phase 403' is formed in the lower part of chamber 405, and the pressure exerted thereby tends to displace upward heat drain 404, whose upper part 406 it is recalled, forms a piston, as represented in FIG. 4B.

Thus the movement of heat drain 404 produced under the effect of pressure, itself caused by the change of state of liquid component 403, drives the vertical part of the heat drain at least partly beyond cold part 402, thus limiting the transfer of heat to this cold part and preventing overheating thereof.

If the temperature nevertheless happens to rise further beyond the vaporization temperature of liquid component 403, this entire component is transformed to gas and the pressure exerted in the lower part of chamber 405 rises in such a way that drain 404 is driven upward so far that its lower part 407 emerges from the fuel forming cold source 402 and finishes its travel at a distance from it.

In this final position, the space situated between lower part 407 of drain 404 and the surface of liquid fuel 402 is filled with a thermally and electrically insulating gas screen (such as air, for example), so that equipment item 401 and liquid fuel 402 forming a cold source are sufficiently insulated thermally and electrically to avoid any risk of fire from fuel 402.

The foregoing exemplary embodiments are merely possible examples of implementation of the invention, which is not limited thereto.

The invention claimed is:

1. A device comprising:

an equipment item including a heat source;

a cold part that is relatively colder than the equipment item, the cold part including a liquid fuel received in a container; and a member being disposed such that, in a first position, the member is at least partly immersed in the liquid fuel and transfers heat from the equipment item to the cold part in order to evacuate the heat dissipated at the equipment item by the heat source, wherein, within a certain thermal condition, the member is not immersed in the liquid fuel such that the equipment item and the cold part are substantially insulated thermally.

2. The device according to claim 1, wherein the equipment item and the cold part are insulated electrically, at least within the certain thermal condition.

3. The device according to claim 1, wherein the equipment item and the cold part are separated by a gas screen, at least within the certain thermal condition.

4. The device according to claim 1, wherein a thermal resistance of the member increases within the certain thermal condition, such that the member becomes substantially insulating.

5. The device according to claim 4, wherein the member comprises at least one component, and wherein a change of state of the component, within the certain thermal condition, causes the thermal resistance of the member to increase.

6. The device according to claim 5, wherein the change of state of the component is a transition from a liquid state to a gas state.

7. The device according to claim 1, wherein the equipment item and the cold part are separated by a gas screen, at least within the certain thermal condition, and wherein the member comprises at least one component which forms the gas screen after a change of state of the component.

8. The device according to claim 1, wherein the member comprises at least one component, and wherein a change of state of the component, within the certain thermal condition, causes the member to lose contact.

9. The device according to claim 8, wherein at least one the component participates in conduction by providing contact from the equipment item to the cold part outside the certain thermal condition and does not provide contact due to the change of state of the component within the certain thermal condition, thus substantially insulating the equipment item and the cold part.

10. The device according to claim 8, wherein a change of a mechanical property of the component during the change of state of the component leads to a movement of a part of the member, thus causing the member to lose contact.

11. The device according to claim 8, wherein the equipment item and the cold part are separated substantially by a gas screen, at least under the certain thermal condition, and wherein the member is configured such that the change of state of the component permits formation of the gas screen.

12. The device according to claim 8, wherein the change of state of the component is a transition from a solid state to a liquid state.

13. The device according to claim 8, wherein the change of state of the component is a transition from liquid state to gas state.

14. The device according to claim 1, wherein the equipment item is a fuel pump.

15. The device according to claim 1, wherein the cold part is a member sensitive to temperature elevations.

16. An aircraft comprising the device according to claim 1.

* * * * *